United States Patent [19]

Arabian et al.

[11] Patent Number: 4,570,823

[45] Date of Patent: Feb. 18, 1986

[54] SOAP SOLUTION DISPENSER INCLUDING INDICATOR MEANS FOR INDICATING THE FILLING STATE THEREOF

[75] Inventors: Sandro Arabian, Vaduz, Liechtenstein; Manfred Baumann; Walter Besserer, both of Diepoldsau, Switzerland

[73] Assignee: CWS AG, Baar, Switzerland

[21] Appl. No.: 563,045

[22] Filed: Dec. 19, 1983

[30] Foreign Application Priority Data

Dec. 24, 1982 [CH] Switzerland ..... 7 544/82

[51] Int. Cl.[4] ..... B67D 5/30

[52] U.S. Cl. ..... 222/26; 222/51; 222/156; 222/181; 222/182; 73/317; 116/229

[58] Field of Search ..... 222/51, 154, 156, 157, 222/158, 181, 28, 182; 73/317; 116/229

[56] References Cited

U.S. PATENT DOCUMENTS

| | | | |
|---|---|---|---|
| 532,981 | 1/1895 | Miller | 73/317 |
| 1,430,189 | 9/1922 | Rinaldi | 222/51 |
| 1,751,847 | 3/1930 | Wilt | 73/317 |
| 2,042,928 | 6/1936 | Dacosta | 222/154 X |
| 2,859,724 | 11/1958 | Cronin et al. | 116/229 |
| 3,187,954 | 6/1965 | Hammer et al. | 222/51 X |
| 3,371,535 | 3/1968 | Martiniak | 222/51 X |
| 4,391,309 | 7/1983 | Steiner | 222/154 X |
| 4,421,249 | 12/1983 | Williamson et al. | 222/154 X |

*Primary Examiner*—Joseph J. Rolla
*Assistant Examiner*—Frederick R. Handren
*Attorney, Agent, or Firm*—Werner W. Kleeman

[57] ABSTRACT

The soap solution dispenser contains a reservoir into which opens an outlet or outflow opening of a container. In the reservoir there is present a float body or float which is pivotably mounted and provided with at least one indicator flag. Conjointly with the drop of the liquid level in the soap solution reservoir the float body also descends, which causes a displacement of the indicator flag. During the lowering of the surface of the soap solution the indicator flag moves along a viewing window formed in a cover or covering hood. There is thus signalled or indicated that the content of the soap solution in the reservoir is quite small or nearly consumed, so that the container now should be exchanged. One resulting advantage of the invention is that the indicator flag moves externally of the soap solution, so that the indicator flag cannot become stuck or bind, and thus, always remains readily visible.

6 Claims, 6 Drawing Figures

SOAP SOLUTION DISPENSER INCLUDING INDICATOR MEANS FOR INDICATING THE FILLING STATE THEREOF

CROSS-REFERENCE TO RELATED APPLICATIONS

This application is related to (i) the commonly assigned, copending U.S. application Ser. No. 06/344,541, filed Feb. 1, 1982, entitled "Apparatus For Forming Portions of Soap Foam" and since granted as U.S. Pat. No. 4,447,000 on Oct. 16, 1984; (ii) the commonly assigned, copending United States application Ser. No. 547,362, filed Oct. 31, 1983, entitled "Exchangeable Container' and (iii) the commonly assigned, copending U.S. application Ser. No. 563,044 filed Dec. 19, 1983, entitled "Method of, and Apparatus For, Feeding A Soap Solution to a Reservoir in a Soap Solution Dispenser".

BACKGROUND OF THE INVENTION

The present invention relates to a new and improved soap solution dispenser.

At times throughout this disclosure, reference to such dispenser will simply generally be made in terms of soap solution dispensers. Equally, while the description to follow, as a matter of convenience, refers to the dispensing of a soap solution, obviously other types of liquids can be conveniently handled, and therefore, the use of this term is not to be construed in any limiting sense in any way whatsoever, but merely is to be viewed as an exemplary and desirable field of application for the inventive measures.

In its more particular aspects the present invention relates specifically to a new and improved soap solution dispenser equipped with indicating means for indicating the filling state thereof and comprising at least one container or flask for a soap solution and a cover or covering hood provided with at least one viewing window.

Indicating means or devices including optical indicators for such soap solution dispensers are known, for example, from European Patent Publication No. 0,023,470, and the optical indicators therein either directly indicate the liquid level or cause a light-to-dark change in a viewing window due to total or internal reflection in a glass body.

The known indicating device has found acceptance in this art. However, the indication or signaling feature of this indicating device can have reduced discernability after longer periods of operation.

SUMMARY OF THE INVENTION

Therefore, with the foregoing in mind it is a primary object of the present invention to provide a new and improved soap solution dispenser in which a reliable and clear indication of the filling state of the soap solution dispenser is achieved at as small expense as possible.

Another and more specific object of the present invention is directed to the provision of a new and improved soap solution dispenser in which a reliable and clear indication of the filling state of the soap solution dispenser is achieved independent of the number of refill or charge exchange operations.

Now in order to implement these and still further objects of the invention, which will become more readily apparent as the description proceeds, the soap solution dispenser of the present development is manifested by the features that, a float body or float provided with at least one indicator flag or marker coupled thereto is provided in the reservoir, and the path of movement or travel of the at least one indicator flag at least partially extends along the viewing window of the cover or covering hood.

The indicating means or device in the soap solution dispenser according to the invention thus contains, in a most simple manner, a float body or float which is movable conjointly with the filling level of the soap solution and an indicator flag coupled to the float body which is aligned with the viewing window of the cover or covering hood in an end or terminal position of the float body, i.e. in a position which it assumes when the container is nearly emptied. The entire indicating means or device is thus extremely simple in its construction. The soap solution level indication or signaling frequency with which the charges are refilled or replaced due to the appearance of the distinctly visible and discernible indicator flag in the viewing window of the cover or covering hood.

Advantageously, there are provided two indicator flags or the like and two viewing windows on different sides of the cover or covering hood in the indicating means or device of the inventive soap solution dispenser. The indication is thus also recognizable in such cases in which one side of the cover or covering hood is inaccessible as, for example, for constructional or mounting reasons.

According to a further advantageous design of the inventive soap solution dispenser, the indicator flag is provided with two differently colored color zones. The indication or signalling function is thus especially distinctly; recognizable in the viewing window of the cover. Furthermore, with increasing withdrawal of soap solution from the reservoir, the color zone which indicates the empty state of the container, progressively enters the viewing window, so that the transition into the final empty state can be clearly recognized and the soap solution can be replenished in due time.

It is of advantage with the soap solution dispenser according to the invention that at least one container or flask opens with at least one outlet or outflow opening into the interior space of the reservoir. The reservoir is thus automatically refilled through at least one outlet of the container when such outlet is no longer immersed into the soap solution.

In accordance with a further advantageous construction of the inventive soap solution dispenser the float body is rotatably mounted in the interior space of the reservoir above the outlet of the container by means of at least one lever. Such design ensures a trouble-free movement of the float body, and thus, of the indicator flag because the mounts or bearings are located above the soap solution and cannot become become contaminated by such soap solution.

According to a further advantageous design of the inventive soap solution dispenser the float body extends over a . substantial portion of the width of the reservoir and is provided with respective levers at its end faces or surfaces. The float body is thus safely and positively guided.

The indicator flag in the inventive soap solution dispenser beneficially extends from the reservoir into a space which is formed between the cover or covering hood and the container. In this region there is also formed the viewing window in the cover or covering hood. A space-saving arrangement is thus obtained, which additionally does not require any specific structural modifications of the soap solution dispenser for the installation of the indicating means or device.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
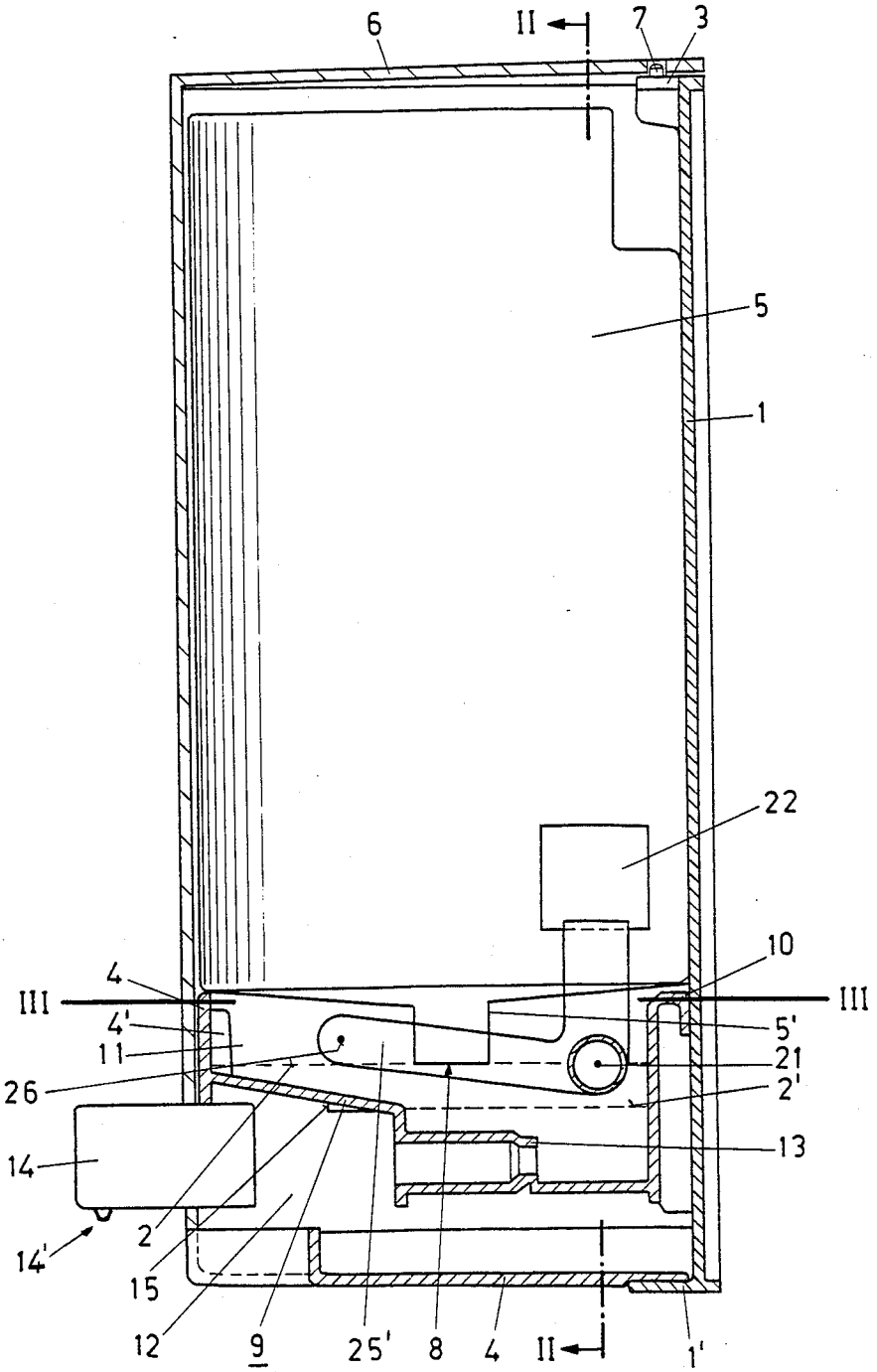
FIG. 1 is a longitudinal central sectional view along the line I—I in FIG. 2 through a soap solution dispenser constructed according to the present invention.

Describing now the drawings, it is to be understood that only enough of the construction of the exemplary embodiment of the soap solution dispenser has been shown as needed for those skilled in the art to readily understand the underlying principles and concepts of the present development, while simplifying the showing of the drawings. Turning attention now specifically to FIG. 1, there has been shown therein a central longitudinal section of the soap solution dispenser according to the invention including retaining or holding means comprising, for example, a rear wall 1 which can be mounted at a wall of a suitable room or the like and from the ends of which protrude respective retainer or holding plates 1' and 3. The lower retainer plate 1' is integrally formed with the rear wall 1 and a reservoir 4 is affixed to the lower retainer plate 1' and which reservoir will be described in greater detail hereinbelow. Supporting webs or ribs 4' are formed at the reservoir 4. A container or flask 5 made of, for instance, transparent material and intended to hold the soap solution to be dispensed is supported at the reservoir 4. This container or flask 5 is provided with a neck portion 5' which defines an outlet or outflow opening 8. The entire arrangement is surrounded by a cover or covering hood 6 which is retained at retaining or holding elements 7 at the upper retainer plate 3 and which is laterally pushed upon the protruding rear wall 1, attention being directed to FIGS. 1 and 3.

The reservoir 4, which is pushed onto the lower retainer or holding plate 1' and which is laterally covered by the cover or covering hood 6, is arranged at the rear wall 1 by means of a mounting or attachment member 10. A bottom or floor member 9 subdivides the reservoir 4 into an interior space or compartment 11 and a pump space or compartment 12. The two spaces or compartments 11 and 12 are interconnected by a cylinder 13 which is open at both its ends and which is inserted into the bottom or floor member 9. A push button or actuator 14 can be displaced between two stops, of which only one stop 15 is visible, against the force of a not particularly illustrated return spring in that portion or region of the pump space 12 which is located remote from the rear wall 1. The push button 14 or equivalent structure is connected to a not specifically illustrated piston, the other end of which is reciprocatingly mounted in the cylinder 13. The lower side of the push button 14 is provided with a discharge outlet or orifice 14' for the soap solution. The push button 14 and the cylinder 13 form members or parts of a dispensing or dosing device which is known as such and which, therefore, is not here further described in any particular detail.

A substantially cylindrical float body or float 21 of the indicating means or device is recognizable in FIG. 1. An indicator flag or tab 22 extends upwardly from the float body 21 and a lever or lever member 25' extends laterally therefrom. The lever 25' is linked or hingedly connected to the reservoir 4 by means of a suitable mount or bearing 26. This lever 25' extends substantially laterally or transversely of the soap solution dispenser from the bearing 26 to the float body 21 and a support 101 extends substantially vertically or upwardly from the float body 21 to the indicator flag 22. The lever 25' adjoins a bent or arcuate portion or region 100 uniting it with the vertical or upright support 101 and at which the float body 21 is mounted. Thus an arcuate portion is formed between the indicator flag 22 and the lever 25'.

Figure 2B:
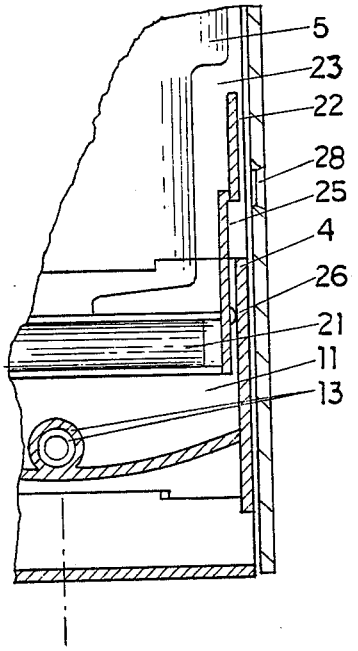
FIG. 2*b* is a partial sectional view showing a second indicator flag or tab arranged on an opposite side of the soap solution dispenser in relation to the single indicator flag or tab shown in FIG. 2.
Figure 2A:
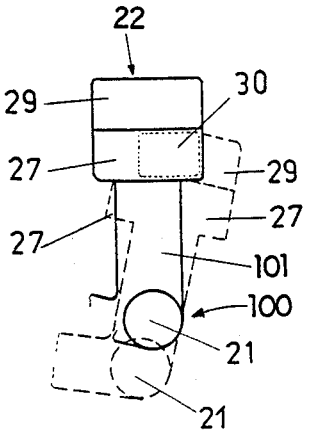
FIG. 2*a* is a view showing the two extreme or end positions of an indicator flag or tab of the indicating means or device of the soap solution dispenser shown in FIG. 1 relative to a viewing window in a cover thereof.
Figure 2:
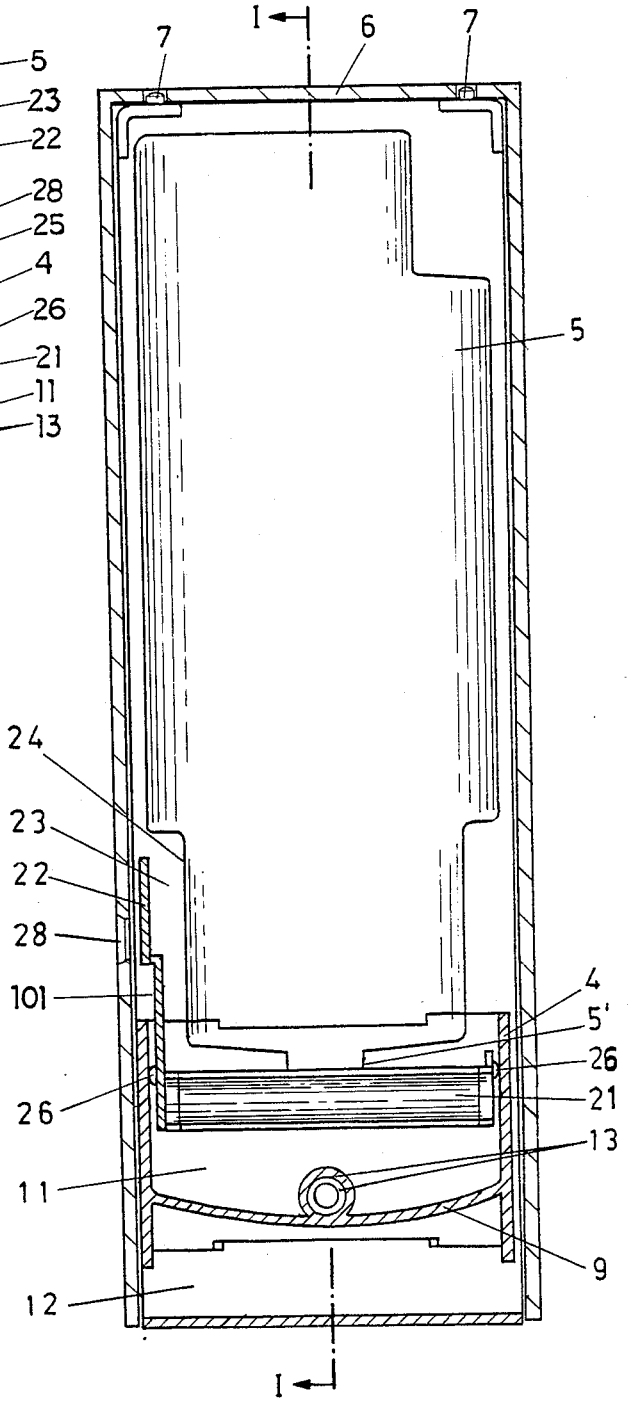
FIG. 2 is a sectional view taken substantially along the line II—II in FIG. 1.

In the sectional view illustrated in FIG. 2 there will be additionally recognized that the indicator flag 22 or equivalent marker is arranged at one end face of the float body 21 and protrudes into a space or chamber 23 which is formed between an indentation or recessed portion 24 at the neck-side end of the container or flask 5 and the cover or covering hood 6. This cover or covering hood 6 is provided with a viewing window 28 through which the indicator flag 22 is clearly visible.

Figure 3:
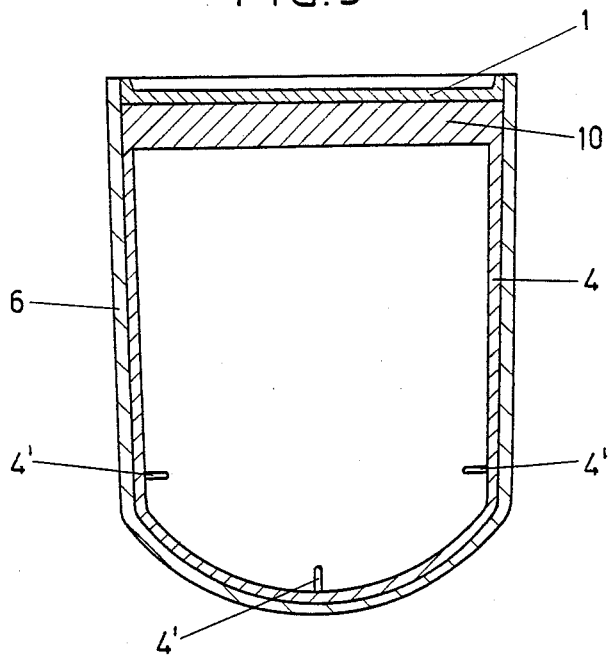
FIG. 3 is a sectional view along the line III—III in FIG. 1 showing the profile of the rear wall, the cover, and the reservoir of the soap solution dispenser shown in such FIG. 1.

The profile or section of the rear wall 1, of the reservoir 4 and of the cover or covering hood 6 illustrated in FIG. 3, shows the mounting member 10 and the supporting webs 4'. It will be recognized that the reservoir 4 is tightly enclosed between the cover or covering hood 6 and the rear wall 1.

Figure 4:
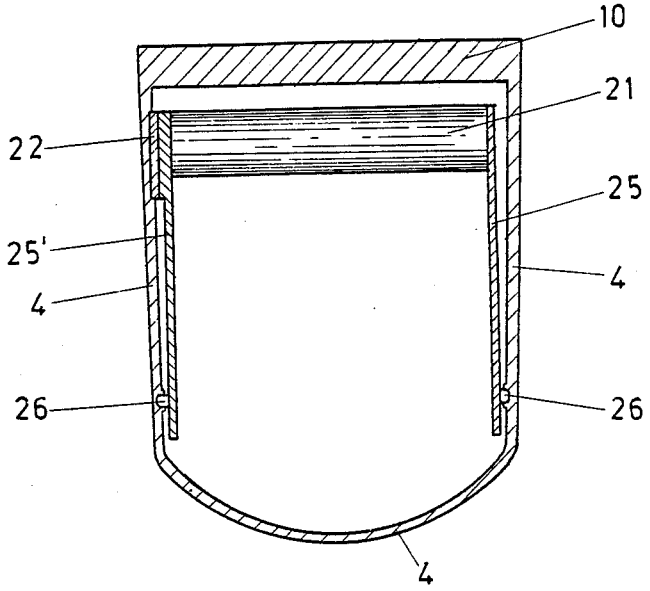
FIG. 4 is a top plan view of a float arrangement . in the soap solution dispenser illustrated in FIG. 1.

The top plan view of FIG. 4 shows the reservoir 4 including the mounting member 10 and the float arrangement including the float body or float 21. From the two end faces or surfaces of the float body 21 there extend levers 25 and 25'. which are linked to the reservoir 4 at the mounts or bearings 26. These mounts or bearings 26 are illustrated as protrusions formed close to the ends of the levers 25, 25' and mounted in corresponding grooves or recesses provided in the associated walls of the reservoir 4. As shown in FIG. 4, only the lever 25' is provided with an indicator flag 22 in this embodiment.

In the following description the mode of operation of the soap solution dispenser including the indicating means or device as shown in FIGS. 1, 2 and 2*a* will be explained. There will be recognized in FIG. 1 an upper liquid level 2 extending at the level of the container mouth defining the outlet or outflow opening 8 of the container or flask 5. This is the normal operative state of the soap solution dispenser which exists as long as soap solution is contained in such container 5. The float body or float 21, then, assumes an upper position as illustrated in FIGS. 1 and 2. As will be evident in detail from FIG. *2a*, the indicator flag or tab 22 contains two marking or indicating zones and 27 and 29 at the end thereof which is remote from the float body 21. These zones 27 and 29 are, for instance, differently colored, and in the presently described embodiment, the color zone 27 is for instance green and the color zone 29 is red. The section or region of the color zone 27 which, in the position of the indicator flag 22 as shown in FIG. 1, can be recognized through the viewing window 28 in the cover or covering hood 6, is indicated in dotted lines in FIG. 2a and designated by reference numeral 30. In the filled operative state of the soap solution dispenser, therefore, the float body 21 floats at the upper liquid level 2 so that the lower colored zone 27 of the indicator flag 22 is aligned with the viewing window 28 in the cover or covering hood 6. The green color of the color zone 27 indicates the operative condition of the soap solution dispenser.

After the container 5 has been emptied the liquid level in the reservoir 4 stepwise or successively drops during further operation to a lower liquid level which is designated by reference numeral 2' in FIG. 1. The float body 21 and thus the indicator flag 22 follow such movement along a path of movement or travel which describes an arc-like circular line. The end or terminal position of the float body 21 including the indicator flag 22 and corresponding to the lower liquid level 2' in FIG. 1 is illustrated by dashed lines in FIG. *2a*. It will be recognized from this illustration that, in this position of the indicator flag 22, the upper color zone 29 which is colored red, is aligned with the viewing window 28 of the cover or covering hood 6 and that the region 30 of the color zone 29 can be clearly recognized through the viewing window 28.

Intermediate both of the end or terminal positions which are shown in FIG. *2a*, the section or region 30 which can be recognized through the viewing window 28 in the cover or covering hood 20 encompasses portions of both color zones 27 and 29. The maintenance personnel is thus alerted to the empty state of the container 5 in due time and prior to the reservoir 4 becoming completely empty.

The cylinder 13 interconnecting the interior space 11 of the reservoir 4 with the pump space or chamber 12 of the reservoir 4 has an opening on one side which is sufficiently large to ensure a satisfactory throughflow of the soap solution. A piston with a throughbore and which is known as such and, therefore, is not particularly illustrated in any detail, is operatively associated with the cylinder 13 and forms a component of the dispensing or dosing device which is connected to the push button 14. The discharge outlet or orifice 14' for soap solution is arranged in the front portion of the lower surface of the push button 14.

In a further development of the invention illustrated in FIG. *2b* an indicator flag is formed at each end face or surface of the float body 21 and, correspondingly, a viewing window 28 is formed on each side of the cover or covering hood 6. The filling state of the soap solution dispenser can then be recognized on two different sides of the cover or covering hood 6, and thus, cannot be impaired by any constructional conditions or the like.

According to a further design the indicator flag may be provided with only one zone or field which becomes visible in the viewing window 28 of the cover or covering hood 6 after the container or flask 5 has been emptied.

The zone or zones do not have to be designed as colored zones or fields, but can also be marked, for example, in a reflecting, luminescent, phosphorescent or otherwise conspicuous manner. The indicator flag 22 may also be located in a region which is farther removed from the rear wall 1. The float body 21 may also be guided at the reservoir 7 by different guide means. I he indicator flag 22 may also extend a different direction and the indicating zone or zones 27, 29 may be formed at different parts of the float arrangement, in which case the viewing window or viewing windows are correspondingly arranged in the cover or covering hood 6.

The soap solution dispenser could also be provided with a fixedly mountable, replenishable container or flask for the soap solution to be dispensed.

While there are shown and described present preferred embodiments of the invention, it is to be distinctly understood that the invention is not limited thereto, but may be otherwise variously embodied and practiced within the scope of the following claims.

Accordingly, what we claim is:

1. A soap solution dispenser comprising:

at least one container holding soap solution; a reservoir;

a cover enclosing said at least one container and said reservoir and including at least one viewing window;

indicating means for indicating the filling state of the soap solution dispenser;

said indicating means comprising a float body provided in said reservoir and equipped with at least one indicator flag operatively coupled thereto;

said float body defining a path of movement of said at least one indicator flag within said cover which at least partially extends along said viewing window;

said at least one container containing at least one outlet;

said reservoir defining an interior space;

said at least one outlet opening into said interior space of said reservoir;

at least one lever for pivotably mounting said float body in said interior space of said reservoir above said at least one outlet;

pivot means arranged in said reservoir above said at least one outlet; and said at least one lever pivotably engaging said pivot means at a region of said at least one lever remote from said float body and said indicator flag.

2. The soap solution dispenser as defined in claim 1, wherein:

two viewing windows are provided, each on a different side of said cover; and two indicator flags are provided, each of which is operatively associated with a respective one of said two viewing windows.

3. The soap solution dispenser as defined in claim 1, wherein: said at least one indicator flag is provided with two differently colored zones.

4. The soap solution dispenser as defined in claim 1 wherein said float body defines end faces;

each one of said end faces being provided with a respective one of said levers;

said reservoir defining a width; and said float body extending over a substantial portion of said width of said reservoir.

5. The soap solution dispenser as defined in claim 1, further including:

a chamber formed intermediate said cover and said container; and said at least one indicator flag extending into said chamber.

6. A soap solution dispenser comprising:

at least one container holding soap solution; a reservoir;

a cover enclosing said at least one container and said reservoir and including at least one viewing window;

indicating means for indicating the filling state of the soap solution dispenser;

said indicating means comprising a float body provided in said reservoir and equipped with at least one indicator flag operatively coupled thereto; said float body defining a path of movement of said at least one indicator flag within said cover which at least partially extends along said viewing window;

said at least one container containing at least one outlet;

said reservoir defining an interior space;

said at least one outlet opening into said interior space of said reservoir;

at least one lever for pivotably mounting said float body in said interior space of said reservoir above said at least one outlet;

said float body defining end faces;

each one of said end faces being provided with a respective one of said levers;

said reservoir defining a width;

said float body extending over a substantial portion of said width of said reservoir;

a respective one of said indicator flags being arranged at each said end face of said float body;

each said indicator flag being formed of one-piece with a related one of said levers; an arcuate portion formed in each of said levers between each said indicator flag and the related one of said levers; and said float body being mounted to said arcuate portions.

* * * * *

UNITED STATES PATENT AND TRADEMARK OFFICE

CERTIFICATE OF CORRECTION

PATENT NO. : 4,570,823

DATED : February 18, 1986

INVENTOR(S) : SANDRO ARABIAN et al

It is certified that error appears in the above—identified patent and that said Letters Patent is hereby corrected as shown below:

Column 1, line 15, after "Container" delete "'" and insert --"--

Column 2, line 17, after "signaling" insert --function is clear and reliable as well as independent of the--

Column 2, line 34, after "tinctly" delete ";"

Column 2, line 60, before "substantial" delete "."

Column 3, line 32, before "in" delete "."

Column 6, line 12, after "means." delete "I"

Column 6, line 13, before "indicator" delete "he" and insert --The--

Signed and Sealed this

*Eighth* Day of *July 1986*

[SEAL]

*Attest:*

DONALD J. QUIGG

*Attesting Officer*

*Commissioner of Patents and Trademarks*